US006736742B2

(12) United States Patent
Price et al.

(10) Patent No.: US 6,736,742 B2
(45) Date of Patent: May 18, 2004

(54) ARROW SWITCHED LIGHTED ARROW NOCK ASSEMBLY

(76) Inventors: Curtis Lee Price, 1979 Knox Rd. 700 N., Peoria, IL (US) 61572; Ivan Eric Price, 507 S. Kellogg St., Yates City, IL (US) 61572

( * ) Notice: Subject to any disclaimer, the term of this patent is extended or adjusted under 35 U.S.C. 154(b) by 0 days.

(21) Appl. No.: 10/371,822

(22) Filed: Feb. 21, 2003

(65) Prior Publication Data

US 2003/0171174 A1 Sep. 11, 2003

Related U.S. Application Data

(60) Provisional application No. 60/361,529, filed on Mar. 5, 2002.

(51) Int. Cl.[7] ..... F42B 6/04
(52) U.S. Cl. ..... 473/570; 473/578
(58) Field of Search ..... 473/578, 586, 473/570; 362/203, 204, 110

(56) References Cited

U.S. PATENT DOCUMENTS 4,340,930 A 7/1982 Carissimi
4,547,837 A 10/1985 Bennett
4,989,881 A 2/1991 Gamble
5,058,900 A * 10/1991 Denen ..... 473/570
5,134,552 A 7/1992 Call
5,425,542 A 6/1995 Blackwood
6,123,631 A 9/2000 Ginder
6,390,642 B1 * 5/2002 Simonton ..... 362/203

* cited by examiner

*Primary Examiner*—Jacob K. Ackun
(74) *Attorney, Agent, or Firm*—Golden's M & I; James B. Golden

(57) ABSTRACT

This invention relates generally to an illuminated nock assembly and more particularly to an illuminating nock for use with an electrically conductive arrow shaft having a nock, illumination member, conductor, and a power source. The illumination member and conductor are in electrical communication with the power source. The nock has a step surface for sandwiching a first protrusion of the illumination member and a second protrusion of the conductor with the arrow shaft illuminating the nock assembly. The principle use is for archers however other applications will benefit from this invention. For example, emergency locators and outdoor lighting displays will benefit from this invention.

21 Claims, 3 Drawing Sheets

Fig. 4.
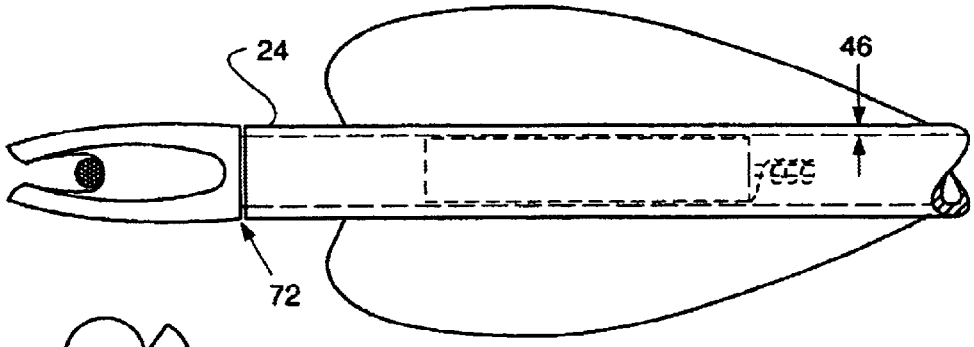
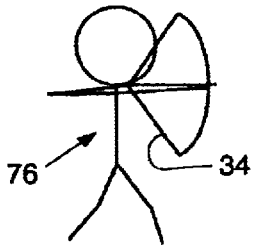
Fig. 4a.
Fig. 5.
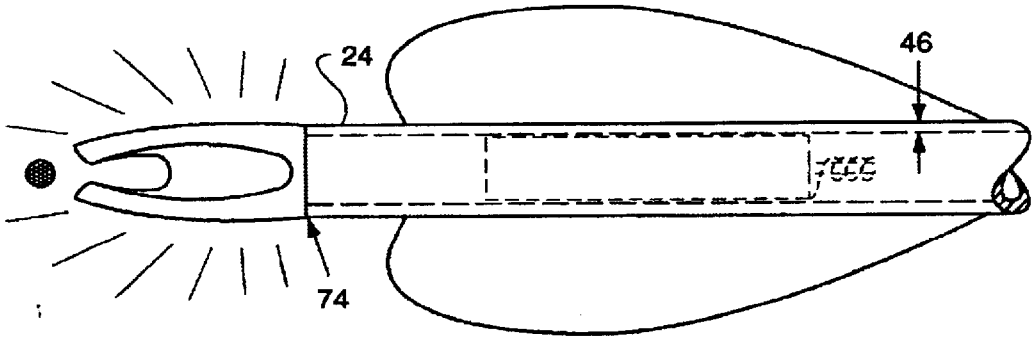
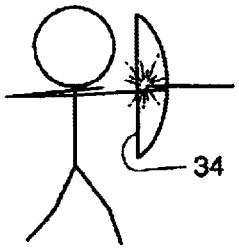
Fig. 5a.

ARROW SWITCHED LIGHTED ARROW NOCK ASSEMBLY

CROSS REFERENCE

The applicant hereby request benefit of the filing of the provisional application 60/361,529 files Mar. 5, 2002 under U.S.C. 119(e). The enclosed non-provisional application, on page 1, has specifically referenced the provisional application.

TECHNICAL FIELD

This invention relates generally to a nock assembly and more particularly to a nock assembly having a first nock portion that is moveable in an arrow shaft for illuminating the nock assembly.

BACKGROUND ART

Archer's equipment, such as, nocks and arrows are being designed to provide archers the ability to track the flight of the arrow. The ability to track the flight of an arrow allows adjustments to be made to the equipment being used and also understand arrow dynamics. Illumination of the archer's nock and/or arrow provides visual feedback to the archer with respect to balance, bow string alignment, and the like. Having this feedback allows the archer to adjust his equipment based on the flight of the arrow. In the field, the archer using illuminated nock and/or arrow will receive immediate feedback with regard to wind dynamics, obstacles, and the like. Having this feedback in the field allows archers to make modifications that increase their ability to hit the desired target.

One problem inherent with illuminated nock and/or arrow is that the added weight may affect flight of the arrow. It has been found that the additional weight of the apparatus required to provide illumination affects arrow balance. An improperly balanced arrow is less likely to fly true and straight. It has also been found that archers may be required to constantly readjust their equipment when switching back and forth from illuminated and non illuminated arrows to maintain accuracy.

Another problem inherent with illuminated nock and/or arrow is that the weight of the components required to provide illumination of the nock and/or arrow adversely affect the devices robustness. It has been found that excessive forces acting on an arrow and it's illuminating component upon release, during flight and on impact may adversely affect its operation and useful life. The importance of reducing complexity and weight to minimize those forces is paramount. It is for these reasons that emphasis has been placed over the past several years on new designs for manufacturing an illuminated nock and/or arrow capable of withstanding higher arrow velocities generated by technological advances in an archer's equipment, while minimizing affect on accuracy.

Various illuminated nocks and/or arrows have been developed in an attempt to improve the archer's results. For example, U.S. Pat. No. 6,123,631 to Ginder discloses a lighted nock that supposedly provides an arrow that is illuminated during flight. However, the nock disclosed requires complex circuitry, in particular, bendable metal contacts that are located in a slot that receives the bow string. In addition, a cap is required to keep the nock from being illuminated when not in use adding cost to the nock. Furthermore, having the bow string come in contact with the bendable metal contacts during the start of arrow flight may decrease the shooting accuracy of the arrow or possibly cause failure of the bowstring. Another example, U.S. Pat. No. 5,134,552 to Call discloses a lighted nock that supposedly provides an arrow that is illuminated during flight by storing energy during the acceleration of the arrow and then releasing that energy when the arrow reaches zero acceleration. However, the nock disclosed requires components, such as a power source, to travel back and forth under spring force which may adversely affect the dynamics of the arrow during flight resulting in reduced accuracy. In addition impact of the arrow with the desired target may reduce the useful life of the nock due to the complexity and resulting weight of the device.

Other designs have been pursued with respect to nock assemblies that are activated prior to flight. For instance, U.S. Pat. No. 4,340,930 to Carissimi discloses a manual switch for illumination. Another example, U.S. Pat. No. 5,425,542 to Blackwood discloses an illumination projectile that is illuminated by threading two components together. Having nock assemblies illuminated prior to arrow flight may allow the desired game to determine the location of the archer and cause the game to flee.

The present invention is directed to overcoming one or more of the problems set forth above.

DISCLOSURE OF THE INVENTION

In one aspect of the present invention, a nock assembly includes a nock having a first nock portion, a second nock portion, and a step surface located between the first nock portion and the second nock portion. The first nock portion has a first end. A nock bore defined by a first curvilinear surface and a longitudinal axis. A pair of apertures disposed in the first nock portion generally adjacent to the step surface and opening into the nock bore. A power source has a case generally engaging the first nock portion, and a terminal. An illumination member has a pair of leads. The illumination member is disposed in the nock bore. One of the pair of leads extends through one of the pair of apertures and another of the pair of leads extends through the nock bore and is in electrical communication with the case. A conductor is in electrical communication with the terminal and extends from the terminal through another of the pair of apertures.

In another aspect of the present invention, a nock assembly for use with an electrically conductive tubular arrow shaft includes a nock having a first nock portion, a second nock portion, and a step surface located between the first nock portion and the second nock portion. The first nock portion has a first end. A nock bore defined by a first curvilinear surface and a longitudinal axis. A pair of apertures generally adjacent to the step surface and opens into the nock bore. The first nock portion is moveably extending into the arrow shaft along the longitudinal axis. A power source has a case generally abutting the first end of the nock, and a terminal. An illumination member has a pair of leads. The illumination member is disposed in the nock bore. One of the pair of leads extends through one of the pair of apertures and another of the pair of leads extends through the nock bore and is in electrical communication with the case. A conductor is in electrical communication with the terminal and extends from the terminal through another of the pair of apertures. A power source holder has a holder bore being defined by a second curvilinear surface and the longitudinal axis. The power source holder is partially disposed in the nock bore, and the power source holder is generally fastened to the first nock portion. A sleeve is disposed about at least a portion of the power source and at least a portion of the power source holder.

In yet another aspect of the present invention, a method of illuminating a nock assembly for use with an electrically conductive tubular arrow shaft has a bowstring defining an aiming position. The nock assembly has a first portion, a second portion, a step surface located between the first and second portions, and a slot defined therein. The method includes the steps of inserting the first portion into the arrow shaft. Positioning the bowstring in the slot. Drawing the bowstring to the aiming position. Releasing the bowstring. Engaging the step surface with the arrow shaft. Illuminating the nock assembly.

In yet another aspect of the present invention, a method for de-illuminating a nock assembly for use with an electrically conductive tubular arrow shaft. The nock assembly has a first portion, a second portion, a step surface located between the first and second portions. The step surface engages the arrow shaft. The method includes the steps of disengaging the step surfacing from the arrow shaft and de-illuminating the nock assembly.

BRIEF DESCRIPTION OF THE DRAWINGS

FIG. 4 is a diagrammatic partial cross-sectional view of the nock assembly and arrow in aiming position embodying the present invention;

FIG. 4A is a symbolic representation of an archer, bow, and arrow showing the position of archer and arrow for the component association shown in FIG. 4;

FIG. 5 is a diagrammatic partial cross-sectional view of the nock assembly and arrow embodying the present invention; and FIG. 5A is a symbolic representation of an archer, bow, and arrow showing the position of archer and arrow for the components association shown in FIG. 5.

BEST MODE FOR CARRYING OUT THE INVENTION

Figure 1:
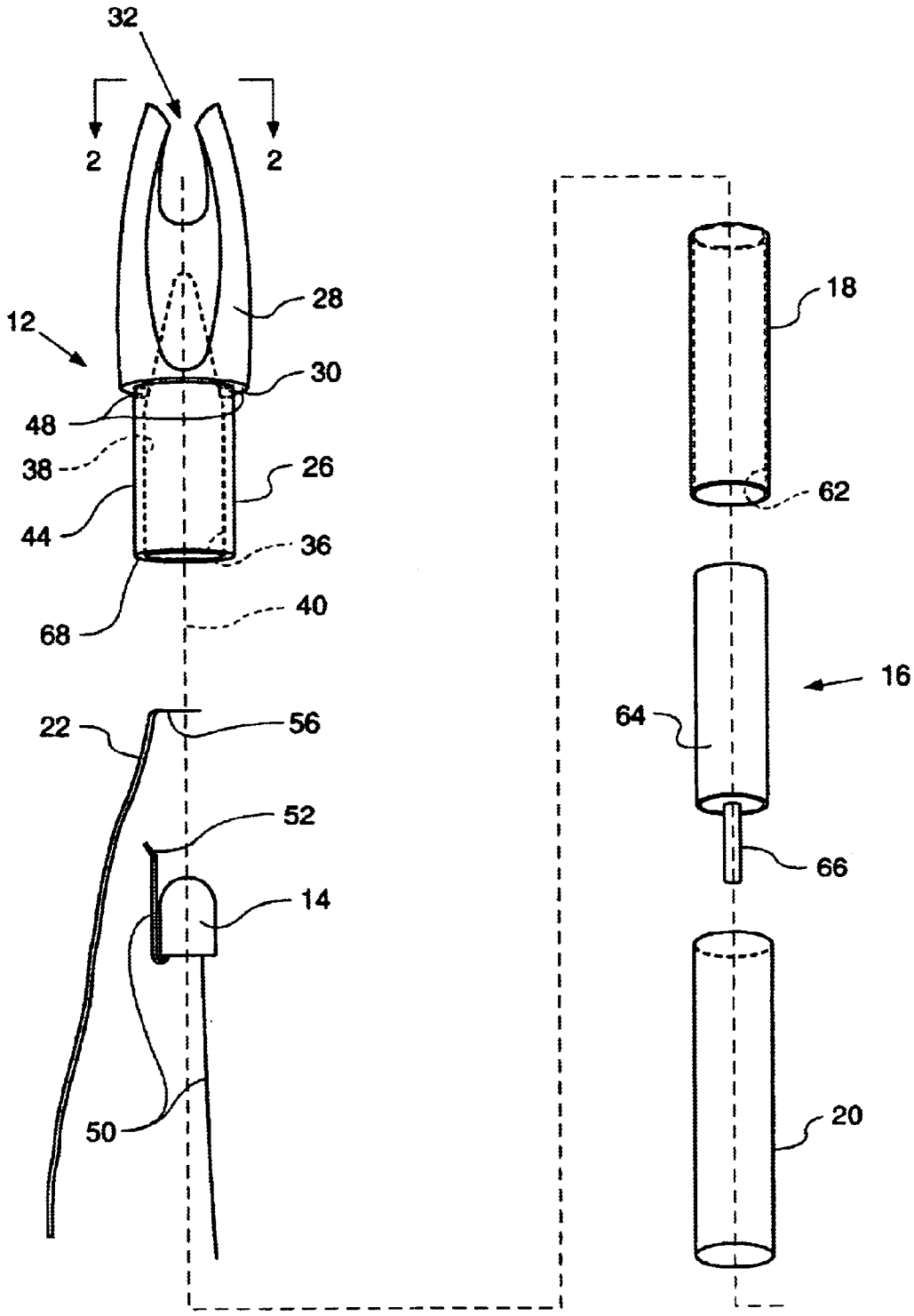
FIG. 1 is an exploded view of a nock assembly embodying the present invention.

Turning to the drawings and particularly to FIG. 1, an exploded view of a nock assembly (10) is shown in one embodiment of the present invention. As seen therein, the nock assembly (10) includes a nock (12), an illumination member (14), a power source (16), a power source holder (18), a sleeve (20), and a conductor (22). In the preferred embodiment, the nock (12) is made of a translucent material for transmitting light. The nock (12) may be made of composites, plastic, & the like without departing from the spirit of the invention. It should be recognized, to one skilled in the art, that nocks (12) made of non-translucent materials may be used as long as light is transmitted from the nock (12) without departing from the spirit of the invention. For example, a non-translucent material with apertures and/or passages formed in the nock (12) transmitting light from the illumination member (14) through the nock (12) may be used. The nock assembly (10) is used with an arrow shaft (24), as depicted in FIG. 4 and FIG. 5. The arrow shaft (24) is typically a tubular arrow shaft (24) that is electrically conductive. However, other configurations of the arrow shaft (24) maybe used without departing from the spirit of the invention, such as, square, oval, and the like that are well known in the art. The electrically conductive arrow shaft (24) may be made of composites, metals, and the like without departing from the spirit of the invention.

The nock (12) includes a first nock portion (26), a second nock portion (28), and a step surface (30) located between the first and second nock portions (26, 28). The second nock portion (28) has a slot (32) disposed therein and the slot (32) positions a bowstring (34) in to the nock (12) for shooting the arrow shaft (24) at a target. The first nock portion (26) has a nock bore (36) defined by a curvilinear surface (38) and a longitudinal axis (40). It should be recognized that other nock bore (36) configurations may be used without departing from the spirit of the invention. For example, nock bores (36) may mirror the shape of the arrow shaft (24), such as, square, oval, and the like as previously discussed. The step surface (30) is of a first magnitude (42) measured from an outer surface (44) of the first nock bore (26) and is generally equal to or less in magnitude than a thickness (46) of the arrow shaft (24). A pair of apertures (48) disposed in the first nock portion (26) are generally adjacent to the step surface (30) and open into the nock bore (36). The pair of apertures (48) are sized to accommodate the gauge of wire used with the illumination member (14) and conductor (22). It should be recognized, the pair of apertures (48) having curvilinear, square, slotted, and the like characteristics may be used without departing from the spirit of the invention.

Figure 2:
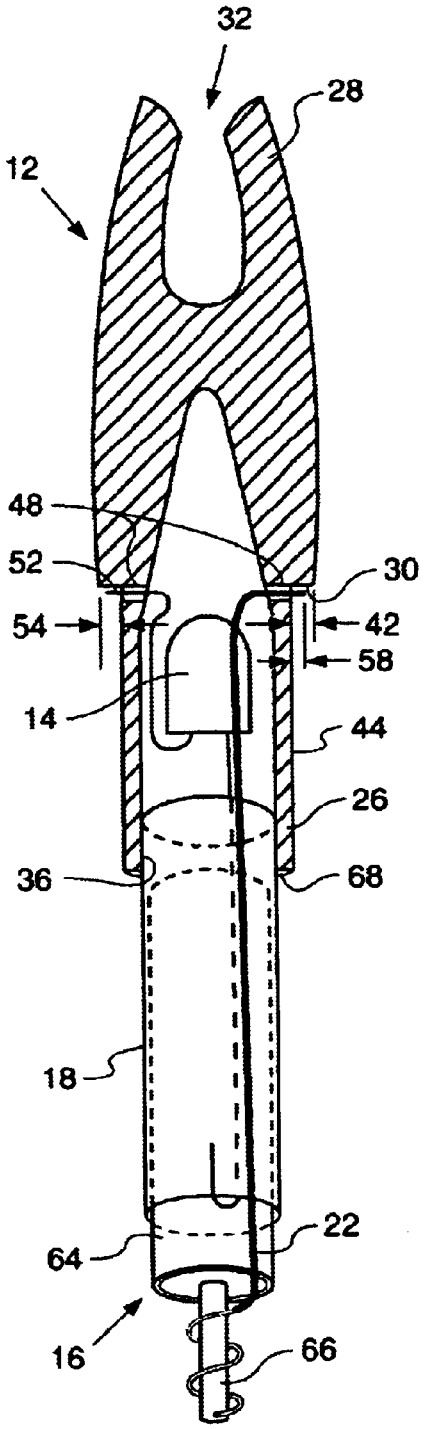
FIG. 2 is a diagrammatic partial cross-sectional view of a nock assembly embodying the present invention.

Referring to FIG. 1 and FIG. 2, the illumination member (14), such as, an LED, diode, light bulb, and the like is disposed in the nock bore (36). The illumination member (14) has a pair of leads (50) for connection to the power source (16). One of the pair of leads (50) extends through one of the pair of apertures (48) adjacent to the step surface (30). A first protruding portion (52) of one of the pair of leads (50) has a second magnitude (54) measured from the outer surface (44) of the first nock portion (26) and is generally equal to or less in magnitude than the first magnitude (42) of the step surface (30). Another of the pair of leads (50) extends through the nock bore and will be discussed in greater detail below. The conductor (22) extends through another of said pair of apertures (48) adjacent to the step surface (30). A second protruding portion (56) of the conductor (22) has a third magnitude (58) measured from the outer surface (44) of the first nock portion (26) and is generally equal to or less in magnitude than the first magnitude (42) of the step surface (30).

Referring to FIG. 1 and FIG. 2, a power source holder (18) has a holder bore (62) defined by a second curvilinear surface (64) and the longitudinal axis (40). The power source holder (18) is partially disposed in the nock bore (36) of the first nock portion (26). In the preferred embodiment, the power source holder (18) is generally fastened to the first nock portion (26) using material with adhesive characteristics, such as, glue, epoxy, and the like. It should be recognized that the connection between the power source holder (18) and the first nock portion (26) may be achieved using fiction, thermal, and mechanical characteristics. For example, a heat gun may be used to melt the power source holder (18) to the first nock portion (26) without departing from the spirit of the invention. The power source (16) is moveably extendable into the holder bore (62). Positioning of the power source (16) into the holder bore (62) provides added rigidity to the nock assembly (10). However, nock assemblies (10) may eliminate the power source holder (18) without departing from the spirit of the invention. For example, the power source (16) may be fastened to the first nock portion (26) with techniques as discussed above for the power source holder (18).

Figure 3:
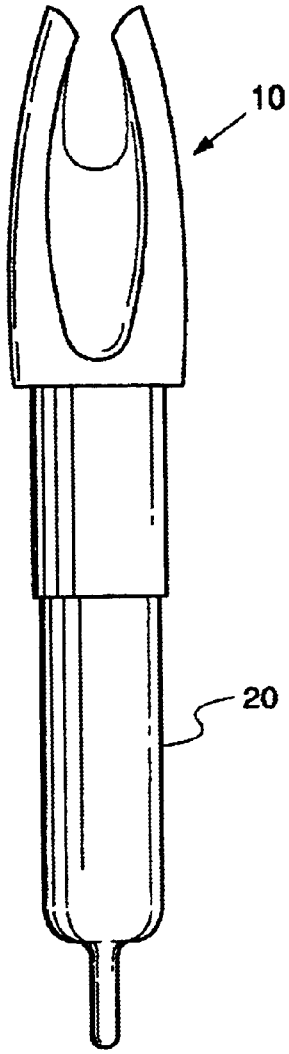
FIG. 3 is a side view of a nock assembly embodying the present invention.

Referring to FIG. 1 and FIG. 2, the power source (16) has a case (64) and a terminal (66). The case (64) generally engages a first end (68) of the first nock portion (26). The first end (68) is generally opposite of the slot (32) of the second nock portion (28). The power source (16) is generally in abuttable engagement with the first end (68) of the nock portion (26). However, the power source (16) may be sized such that the power source (16) extends into the nock bore (36) without departing from the spirit of the invention. The power source (16) is typically a battery but other sources that are well known in the art may be used without departing from the spirit of the invention. The conductor (22) is in electrical communication with the terminal (66) of the power source (16). The conductor (22) adjacent to the case (64) is generally insulated. Insulating the conductor (22) adjacent to the case (64) prevents the conductor (22) from completing a circuit between the terminal (66) and the case (64). The conductor (22) is generally disposed between the nock bore (36) and the power source holder (18) further preventing the circuit between the terminal (66) and the case (64) from occurring. Another one of the pair of leads (50) of the illumination member (14) extends through the nock bore (36) and is generally disposed between the case (64) and the holder bore (62) enhancing electrical communication between said illumination member (14) and the power source (16). Another one of the pair of leads (50) may be bent over the power source holder (18) providing a more rigid nock assembly (10). A sleeve (20) is disposed about at least a portion of the power source (16) and at least a portion of the power source holder (18) to further enhance rigidity of the nock assembly (10). The sleeve, as shown in FIG. 3, is generally made of a shrinkable material that enhances rigidity of the nock assembly (10) during operation, i.e., maintains electrical communication between the illumination member (14) and the power source (16) as well as between the conductor (22) and the power source (16).

Referring to FIG. 4 and FIG. 5, the nock assembly (10) is shown with the arrow shaft (24). The first nock portion (26) is moveably extendable into the arrow shaft (24) along the longitudinal axis (40). The first nock portion (26) is generally in frictional engagement with the arrow shaft (24). The frictional engagement enhances the positioning characteristics of the nock assembly (10) with the arrow shaft (24). The first nock portion (26) is moveably extendable into the arrow shaft (24) to a first position (72). The first position (72) spaces the step surface (30) from the arrow shaft (24). The first position (72) corresponds to an open circuit between one of the pair of leads (50) and the conductor (22). The first position (72) is generally spaced from the arrow shaft (24) between 0.002 inches and 0.004 inches. The nock assembly (10) is typically maintained at the first position (72) as the archer places the arrow shaft (24) in the aiming position (76). The first nock portion (26) is further moveably extendable into the arrow shaft (24) along the longitudinal axis (40) to a second position (74). The second position (74) engages the step surface (30) with the arrow shaft (24). The second position (72) corresponds to a closed circuit between one of the pair of leads (50) and the conductor (22) causing the illumination member (14) to illuminate. The step surface (30) is generally forcibly engaged with the arrow shaft (24) using the bowstring (34) or force applied by the archer. However, engaging the step surface (30) with the arrow shaft (24) may be accomplished using fixed obstacles to movably extend the first nock portion (26) to the second position (74). For example, using the ground to moveably extend the first nock portion (26) to the second position (72) may be used without departing from the spirit of the invention. Movement to the second position (74) is accomplished by applying a force generally between 5 pounds and 30 pounds to the nock assembly (10). The force applied to moveably extend the step surface (30) to the second position (74) sandwiches the first and second protruding portions (52, 56) between the step surface (30) and the arrow shaft (24). In the preferred embodiment, the illumination of the illumination member (14) is constant. However, variable illumination may be used without departing from the spirit of the invention. For example, multiple archers may use different rates of illumination, such as, blinking, brightness, and the like illumination to aid in identifying particular arrow shafts (24). It should also be recognized that archers may use different color for illumination, be it from nock material or illumination, to aid in recovering arrow shafts (24).

INDUSTRIAL APPLICABILITY

With reference to the Figs. and in operation, accuracy in the flight of the arrow shaft (24), recovery of the arrow shaft (24) after flight, rigidity of the nock assembly (10), and the like are enhanced by using the nock assembly (10). For example, adjustments with respect to arrow deflection as well as alignment of vanes, feathers, and arrow heads may be detected and corrected and improve the accuracy of arrow flight by using the nock assembly (10). The weight of the nock assembly (10) is generally similar to the weight of an archer's non-illuminating nock which allows the archer to minimize adjustments to archery equipment based on type of nock used during operation. Further, the increase in rigidity of the nock assembly (10) enhances the useful life of the nock assembly (10).

Referring to FIG. 4A and FIG. 5A, in operation an archer inserts the nock assembly (10) into the arrow shaft (24) to the first position (72). The friction engagement between the first nock portion (26) and the arrow shaft (24) allows the archer to align the nock assembly (10) with the arrow shaft (24). Once the nock assembly (10) is aligned with the arrow shaft (24) the bowstring is positioned in the slot (32) of the nock assembly (10). The archer then draws the bowstring back to the aiming position (76). At this point, the step surface (30) of the nock assembly (10) is spaced from the arrow shaft (24) maintaining the open circuit between one of the pair of leads (50) and the conductor (22). The archer is able to take aim at the target with a non-illuminated nock assembly (10) allowing the archer to be unnoticed to the desired target. The archer releases the bowstring (24) which in turn provides the necessary inertia force to movably extend the nock assembly to the second position (74). The second position (74) engages the step surface (30) with the arrow shaft (24), i.e., sandwiches the first and second protruding portions (52, 56) with the arrow shaft (24) completing the closed circuit between one of the pair of leads (50) and the conductor (22). The nock assembly (10) in the second position (74), i.e., closed circuit illuminates the illumination member (14). Once the arrow shaft (24) has completed flight the archer determines with the aid of the illuminated nock assembly (10) the spot where the arrow shaft (24) impacted and where the arrow shaft (24) comes to rest and retrieves the arrow shaft (24). The archer, with the illuminated arrow shaft (24), engages the nock assembly (10) and moveably extends the step surface (30) of the nock assembly (10) from the second position (74) to generally the first position (72). Movement of the step surface (30) from the second position (74) to the first position (72) de-illuminates the nock assembly (10). It should be recognized that the archer may disengage the nock assembly (10) from the arrow shaft (24) without departing from the spirit of the invention. For example, archers who have completed their session using the arrow shaft (24) may store the nock assembly (10) separate from the arrow shaft (24).

Other aspects, objects and advantages of this invention can be obtained from a study of the drawings, the disclosure and the appended claims.

What is claimed is:

1. A nock assembly, comprising:

a nock having a first nock portion, a second nock portion, and a step surface located between said first nock portion and said second nock portion, said first nock portion having a first end, a nock bore defined by a first curvilinear surface and a longitudinal axis, and a pair of apertures disposed in said first nock portion generally adjacent to said step surface and opening into said nock bore;

a power source having a case generally engaging said first nock portion, and a terminal;

an illumination member having a pair of leads, said illumination member being disposed in said nock bore, and one of said pair of leads extending through one of said pair of apertures and another of said pair of leads extending through said nock bore and being in electrical communication with said case; and a conductor being in electrical communication with said terminal and extending from said terminal through another of said pair of apertures.

2. The nock assembly, as set forth in claim 1, wherein said second portion of said nock having a slot disposed therein.

3. The nock assembly, as set forth in claim 1, wherein said nock being made of a translucent material.

4. The nock assembly, as set forth in claim 1, wherein said conductor adjacent said case being generally insulated.

5. The nock assembly, as set forth in claim 1, wherein said first nock portion having a power source holder partially disposed therein, said power source holder having a holder bore being defined by a second curvilinear surface and said longitudinal axis, said power source holder being partially disposed in said nock bore, and said power source holder being generally fastened to said first nock portion.

6. The nock assembly, as set forth in claim 5, wherein said power source being moveably extending into said holder bore.

7. The nock assembly, as set forth in claim 5, wherein said another one of said pair of leads being disposed between said case and said holder bore.

8. The nock assembly, as set forth in claim 5, wherein said conductor being disposed between said nock bore and said power source holder.

9. The nock assembly, as set forth in claim 5, wherein said power source holder being fastened to said first nock portion using material having adhesive characteristics.

10. The nock assembly, as set forth in claim 6, wherein said power source and said power source holder having a sleeve being disposed about at least a portion of said power source and at least a portion of said power source holder.

11. The nock assembly, as set forth in claim 10, wherein said sleeve being made of a shrinkable material.

12. A nock assembly for use with an electrically conductive tubular arrow shaft, comprising:

a nock having a first nock portion, a second nock portion, and a step surface located between said first nock portion and said second nock portion, said first nock portion having a first end, a nock bore defined by a first curvilinear surface and a longitudinal axis, and a pair of apertures generally adjacent to said step surface and opening into said nock bore, said first nock portion being moveably extending into said arrow shaft along said longitudinal axis;

a power source having a case generally abutting said first end of said nock, and a terminal;

an illumination member having a pair of leads, said illumination member being disposed in said nock bore, and one of said pair of leads extending through one of said pair of apertures and another of said pair of leads extending through said nock bore and being in electrical communication with said case;

a conductor being in electrical communication with said terminal and extending from said terminal through another of said pair of apertures;

a power source holder having a holder bore being defined by a second curvilinear surface and said longitudinal axis, said power source holder being partially disposed in said nock bore, and said power source holder being generally fastened to said first nock portion, and a sleeve being disposed about at least a portion of said power source and at least a portion of said power source holder.

13. The nock assembly for use with an electrically conductive tubular arrow shaft, as set forth in claim 12, wherein said first nock portion moveably extending into said arrow shaft to a first position, and said first position being defined by said step surface being spaced from said arrow shaft and said first position corresponds to an open circuit between one of said pair of leads and said conductor.

14. The nock assembly for use with an electrically conductive tubular arrow shaft, as set forth in claim 12, wherein said first nock portion moveably extending into said arrow shaft to a second position, and said second position being defined by said step surface being forcibly engaged with said arrow shaft and said second position corresponds to a closed circuit between one of said pair of leads and said conductor.

15. The nock assembly for use with an electrically conductive tubular arrow shaft, as set forth in claim 14, wherein said second position sandwiches said one of said pair of leads and said conductor between said step surface and said arrow shaft.

16. The nock assembly for use with an electrically conductive tubular arrow shaft, as set forth in claim 14, wherein said second position illuminates said illumination member.

17. The nock assembly for use with an electrically conductive tubular arrow shaft, as set forth in claim 12, wherein said first nock portion being in frictional engagement with said arrow shaft.

18. The nock assembly for use with an electrically conductive tubular arrow shaft, as set forth in claim 13, wherein said step surface being spaced generally between 0.002 inches and 0.004 inches.

19. The nock assembly for use with an electrically conductive tubular arrow shaft, as set forth in claim 14, wherein said forcibly engagement being generally between 5 pounds of force and 30 pounds of force.

20. A method of illuminating a nock assembly for use with an electrically conductive tubular arrow shaft having a bowstring defining an aiming position, said nock assembly having a first portion, a second portion, a step surface located between said first and second portions, and a slot defined therein, the method comprising the steps of:

inserting said first portion into said arrow shaft;

positioning said bowstring in said slot;

drawing said bowstring to said aiming position;

releasing said bowstring;

engaging said step surface with said arrow shaft; and illuminating said nock assembly.

21. A method for de-illuminating a nock assembly for use with an electrically conductive tubular arrow shaft, said nock assembly having a first portion, a second portion, a step surface located between said first and second portions, and said step surface engaging said arrow shaft, the method comprising the steps of:

disengaging said step surfacing from said arrow shaft; and de-illuminating said nock assembly.

* * * * *